United States Patent [19]

Miller Ralph L.

[11] 3,965,296

[45] June 22, 1976

[54] SIGNALING SYSTEM

[75] Inventor: Miller Ralph L., Chatham, N.J.

[73] Assignee: Bell Telephone Laboratories, Incorporated, Murray Hill, N.J.

[22] Filed: June 30, 1944

[21] Appl. No.: 542,975

[52] U.S. Cl. ..... 179/1.5 R; 178/72

[51] Int. Cl.[2] ..... H04K 1/02

[58] Field of Search ..... 179/1.5, 15, 171 A, 179/171 B, 1 SA; 343/5 X; 178/22

[56] References Cited

UNITED STATES PATENTS

| | | | |
|---|---|---|---|
| 1,752,485 | 4/1930 | Hartley | 179/1.5 |
| 2,048,081 | 7/1936 | Riggs | 179/1.5 A |
| 2,098,956 | 11/1937 | Dudley | 179/15 |
| 2,151,091 | 3/1939 | Dudley | 179/1.5 |
| 2,185,367 | 1/1940 | Blumlein | 179/171 B |
| 2,199,634 | 5/1940 | Koch | 179/1.5 |
| 2,256,085 | 9/1941 | Goodale | 179/171 B |
| 2,296,920 | 9/1942 | Goodale | 179/171 B |
| 2,329,073 | 9/1943 | Mitchell et al. | 179/171 A |
| 2,451,484 | 10/1948 | Gould | 343/5 |

*Primary Examiner*—Howard A. Birmiel
*Attorney, Agent, or Firm*—H. A. Burgess

EXEMPLARY CLAIM

1. In a signaling system, a plurality of input circuits carrying signal currents, a corresponding plurality of individual output channels, a privacy equipment common to said circuits and channels for rendering said signal currents unintelligible, a first set of relays for operatively associating said input circuits one at a time with said privacy equipment, a second set of relays for operatively associating said privacy equipment with said channels one at a time, and a common timing circuit for operating the relays of each set in timed sequence.

18 Claims, 8 Drawing Figures

INVENTOR
R. L. MILLER
BY H. A. Burgess
ATTORNEY

INVENTOR
R. L. MILLER
BY
H. A. Burgess
ATTORNEY

INVENTOR
R. L. MILLER
BY
N. A. Burgess
ATTORNEY

INVENTOR
R. L. MILLER

BY H. A. Burgess
ATTORNEY

INVENTOR
R. L. MILLER
BY
H. A. Burgess
ATTORNEY

INVENTOR
R.L. MILLER
BY H. A. Burgess
ATTORNEY

SIGNALING SYSTEM

The present invention relates to secret signaling and especially to secret telephony, the general object being to secure a high degree of security against unauthorized reception with relatively simplified apparatus.

The system to be disclosed herein for illustration of the invention is based upon a type of system known as the vocoder and disclosed and claimed in U.S. Pat. No. 2,151,091 to H. W. Dudley patented Mar. 21, 1939. In the vocoder, speech waves are analyzed into a number of low frequency defining waves which can be transmitted to a distance and there used to reconstruct speech waves with the aid of locally produced tone and noise waves. It has been proposed heretofore to provide secret telephony by use of vocoder type of transmission and to separately encipher the different low frequency defining currents. One such secrecy system is disclosed in an application of Lundstrom and Schimpf Ser. No. 456,322, now U.S. Pat. No. 3,897,591, issued July 29, 1975, filed Aug. 27, 1942. Systems which represent a simplification or economy in the apparatus required, relative to the type of system as disclosed by Lundstrom and Schimpf, are shown in an application of E. Peterson Ser. No. 542,922 and in an application of H. W. Dudley Ser. No. 542,946 now U.S. Pat. No. 3,470,323, issued Sept. 30, 1969, both filed of even date herewith. In both of the latter applications a saving is effected in equipment by making certain apparatus common to different vocoder channels, specifically be providing that it be used at different times by different channels in succession.

The present invention is in the nature of an improvement upon such systems as disclosed by Peterson and by Dudley. It follows their practice of using certain apparatus in common for different vocoder channels on a time division basis but incorporates many important improvement features resulting in a still further saving of apparatus and in generally improved transmission. These various improvement features relate to the distributors, timing circuit, pitch channel, steppers, amplifying and stabilizing circuits, and various auxiliary features to be fully disclosed hereinafter.

The advantages of long pulses on the line as provided in the systems of Lundstrom-Schimpf and of Peterson are retained in the present disclosure but by the use of simplified apparatus. The short pulses in the output of the common output stepper in accordance with the present invention are distributed in successive instants of time to individual storage circuits in the carrier transmission channel inputs and these storage circuits are so arranged as to hold their stored pulses throughout the long pulse duration time. Not only is there a great saving of apparatus in dispensing with such elements as individual channel steppers but there is a consequent great saving in power supply apparatus.

Applicant has devised distributors making use of small fast-acting electromagnetic relays controlled in their action by a gas tube ring circuit so constructed that a proper timed relation is secured between the relays of the same distributor and also between the relays of different distributors working in tandem.

The nature and objects of the invention and its various features including those already referred to will appear more fully from the following detailed description in connection with the accompanying drawing in which:

FIGS. 1 and 2 when placed side by side with FIG. 2 at the right of FIG. 1 show in schematic circuit diagram a transmitting terminal in accordance with the invention;

FIGS. 3 and 4 when placed together with FIG. 4 at the right of FIG. 3 show in schematic circuit diagram a receiving terminal in accordance with the present invention;

Figure 1:
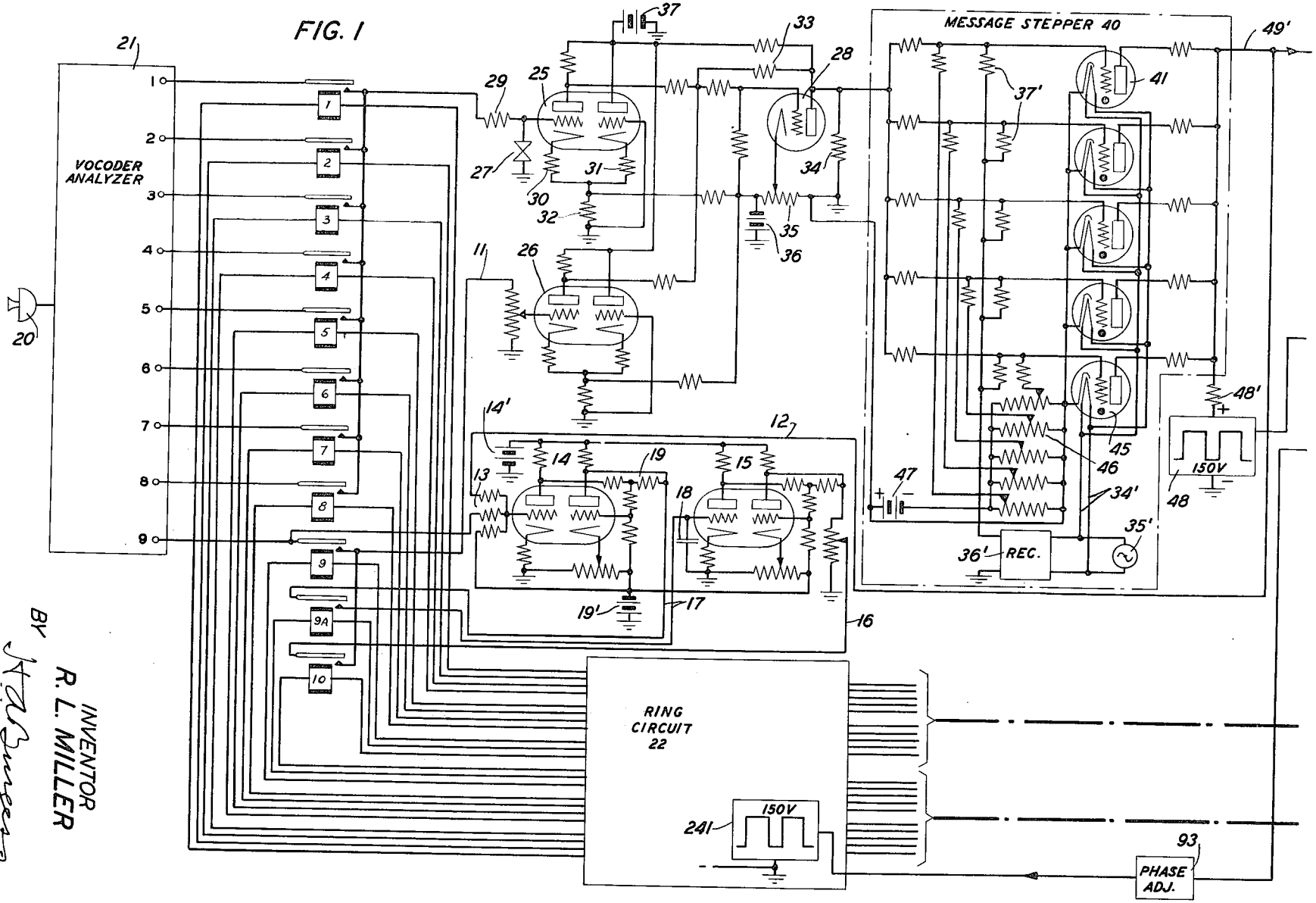
Figure 2:
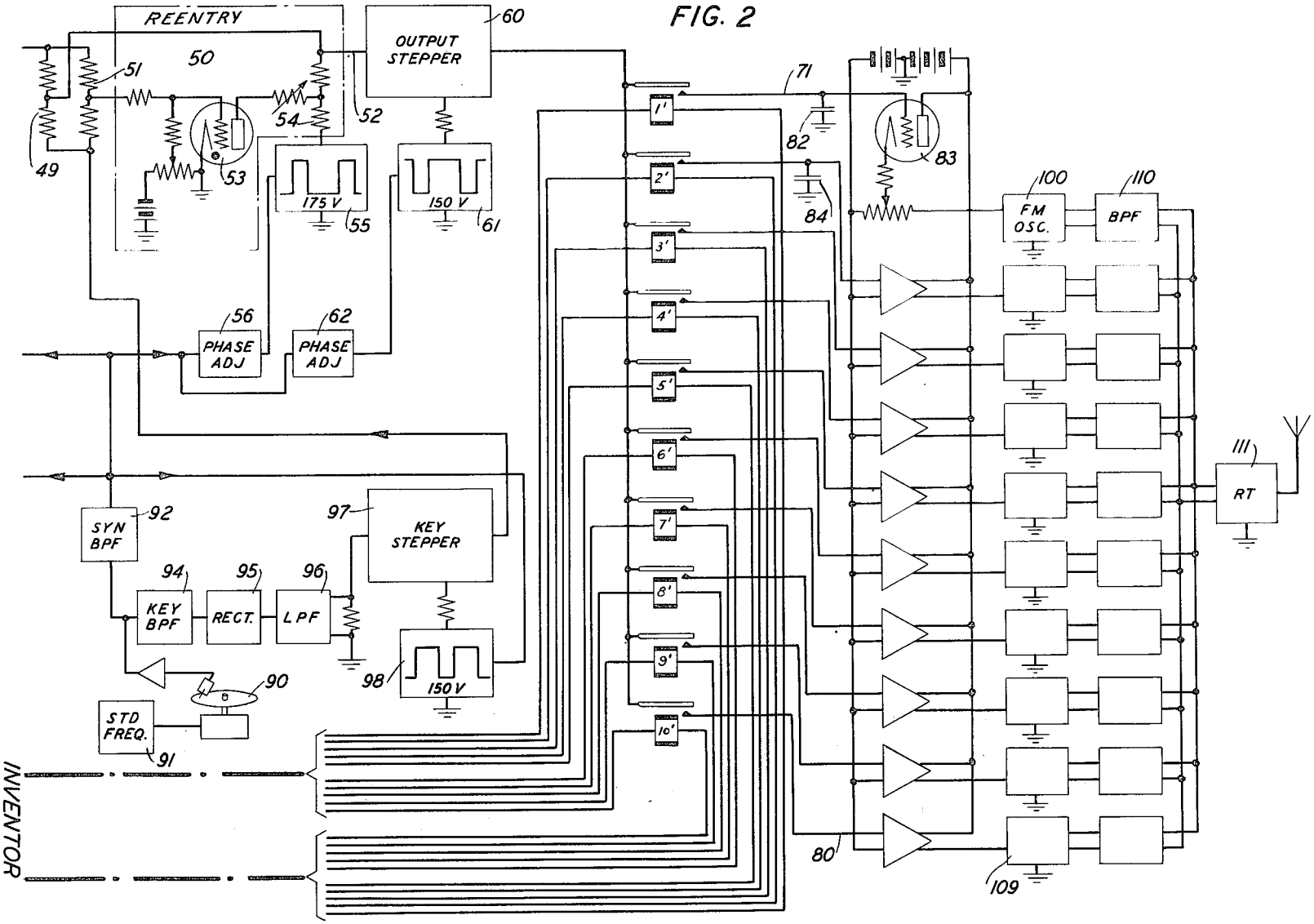

Referring first to FIGS. 1 and 2, the speech waves spoken into the microphone 20 or other speech input circuit are analyzed in the vocoder analyzer 21 which is shown as comprising nine channels, channels 1 to 8 of which are the spectrum channels and channel 9 is the fundamental pitch channel, there channels corresponding in function to those of the analyzer circuit of the Dudley patent referred to. The set of relays 1 to 8, inclusive, is controlled from the ring circuit 22 to be operated in sequence with each other, and together they form a distributor for connecting the channels 1 to 8 in rapid succession to the input of the common amplifier 25. Relay 9 is operated in sequence with relay 8 and momentarily connects the pitch channel 9 to the input of amplifier 26. Relay 10 is operated in sequence with relay 9 for the purpose of enabling the transmission of pulses indicating the fractions of a step into which the pulses in channel 9 are subdivided, channels 9 and 10 together transmitting much smaller gradations of pitch-defining pulses than would be transmitted by channel 9 alone. Relay 9A operates momentarily between the operate times of relays 9 and 10 for assisting in the setting up of the channel 10 pulses as will be described more fully. It is to be understood from the foregoing that the relays 1 to 10 operate sequentially in repeated cycles.

Figure 5A:
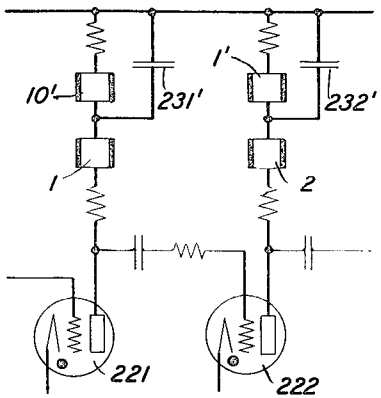
FIG. 5A shows a detail modification of the FIG. 5 circuit.
Figure 5:
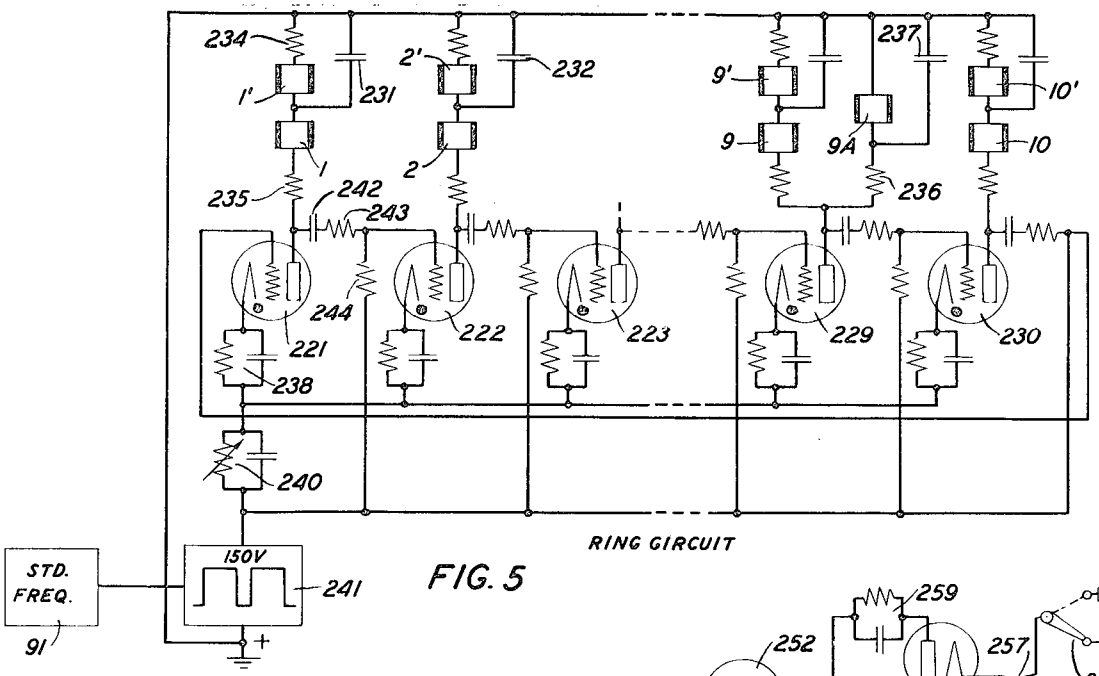
FIG. 5 is a detailed schematic circuit diagram of the ring circuit shown in block in FIGS. 1 and 3.

The ring circuit 22 to be described more fully in connection with FIG. 5 comprises ten gas-filled tubes operating in sequence in a closed ring for, in turn, sending energizing current through the relays 1 to 10, inclusive. For this purpose each numbered relay is shown as having two leads extending into the box 22.

A second set of relays 1' to 10' shown in FIG. 2 is also sequentially operated under control of the ring circuit 22, the leads for energizing these relays being shown extending from the right side of box 22. As will be described in connection with FIG. 5, relay 1' is arranged to operate 1.25 milliseconds after relay 1 and this same relation holds for the other prime-numbered relays with respect to the corresponding unprimed relays. The relays 1' to 10' serve to connect the output side of output stepper 60 to the input terminals of each of the multiplex carrier channels 71 to 80 in sequence.

The relays 1 to 10 may be considered as a first distributor, therefore, for connecting the vocoder channels in succession to certain common apparatus comprising amplifier 25 or 26, message stepper 40, reentry circuit 50 and output stepper 60 while the second group of relays 1' to 10' may be considered as a second distributor for connecting the output of this common apparatus to the various transmission channels 71 to 80.

Referring more in detail to the common apparatus mentioned, the two direct current amplifiers 25 and 26 are coupled to the single tube amplifier stage 28. As noted, amplifier 25 serves the channels 1 to 8 while amplifier 26 serves the two pitch channels 9 and 10. Amplifier 28 is common to all vocoder channels 1 to 10. The purpose of providing the two input amplifiers 25 and 26 is to enable volume compression to be used for the spectrum channels 1 to 8 only, this being provided by means of the non-linear shunt impedance 27 which may comprise a silicon carbide varistor known to the trade as Thyrite. This serves in conjunction with resistor 29 to reduce the volume range of vocoder currents supplied to amplifier 25.

Since the currents in the vocoder analyzer channels comprise slowly varying direct currents with a maximum frequency of variation of about 25 cycles per second, it is necessary that the amplifiers 25 and 26 transmit direct current. Considering first amplifier 25, this comprises, with amplifier 28, two stages, the first stage consisting of the left-hand triode in the common envelope and the second stage comprising triode 28. The second triode in the common envelope compensates for variations in cathode emission or contact potential in amplifier 25. It is noted that the signal is not impressed upon this second half of the tube. The individual cathode resistor 31 is smaller than the cathode resistor 30. Also it is noted that there is no plate feed resistor for the plate of the second half of the duplex tube. Contact potentials between the grid and filament in the right-hand half produce current in the common cathode-to-ground resistor 32, this current being larger than current of similar origin in the left-hand half because of the smaller value of resistance 31 as compared with 30 and of the higher voltage on the plate. The portion of the current in resistor 32 which represents contact potential effects or variations in cathode emission contributed from the right-hand half of the tube set up a grid bias potential in the left-hand half which may be of just the right magnitude and sign to compensate for variations in cathode emission in this half, assuming that the variations are similar in both halves. Amplifier 26 operates in an entirely similar manner to impress the amplified fundamental pitch channel variations on the input of common amplifier 28.

The resistances shown between the plates of tubes 25 and 26 and the grid of tube 28 are all of relatively high value and the resistances that are connected between the positive terminal of battery 37 and the negative terminal of battery 36 are proportioned to provide the proper direct current potentials at the various points at which elements are connected into this resistance branch. For example, in order that zero input signal from a vocoder channel may produce zero input voltage into the stepper 40 from coupling resistor 34 it is necessary that the cathode of tube 28 be connected at such point on resistor 35 as to result in zero difference of potential across coupling resistor 34 when there is no impressed signal on amplifier 25 or 26. In one typical instance this condition was obtained when the cathode of the tube 28 was at −70 volts with respect to ground and when the internal drop of potential between the cathode and anode was also 70 volts. The resistances referred to as connected between the positive pole of battery 37 and negative pole of battery 36, acting as a potentiometer, serve to compensate for variations in battery voltage. The feedback connection through resistance 33 (e.g. 1 megohm) lowers the plate-to-cathode resistance of tube 28 to cause it to provide a suitable resistance across the input terminals of the message stepper 40.

The message stepper 40 comprises five gas-filled tubes 41 to 45 having their cathodes all connected to ground at the bottom of coupling resistor 34 and having their grids individually connected through series resistors to the upper terminal of coupling resistor 34. These tubes 41 to 45 are given graduated firing voltages by providing potential divider resistors 46 through which biasing current from negative battery 47 flows and by connecting the grids to different points along the resistances 46. These biases are so adjusted that as different input signals are impressed from tube 28 on the stepper circuit one or more of the tubes 41 t0 45 or none will fire, depending upon the strength of the impressed current. The adjustment is such that the strongest signal to be encountered will fire all five tubes, the weakest signals will not fire any of the tubes, and the intermediate range will be subdivided into substantially equal steps indicated by the firing of one or two, or three, or four tubes.

Figure 7:
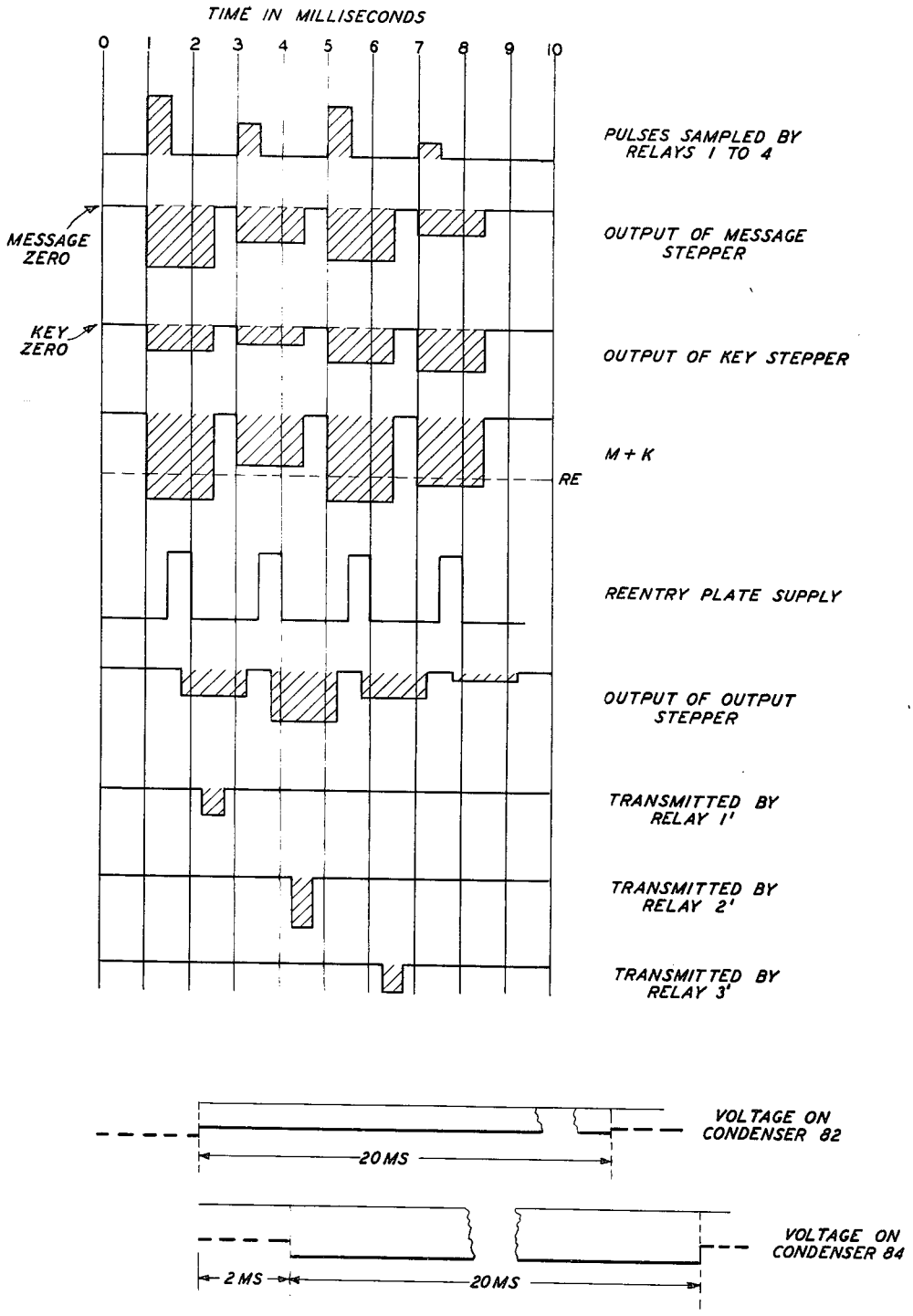
FIG. 7 shows shapes of pulses and timing relations.

Plate voltage is supplied to the tubes 41 to 45 in the form of timed pulses from the pulsing circuit 48 which drives the plates of all of the tubes positive for 1.5 milliseconds and then drops the voltage to zero for 0.5 millisecond, repeating this process indefinitely. The tubes are thus put into condition to be fired for 1.5 out of each 2 milliseconds period, the firing of the tubes being under control of the impressed grid potentials. As indicated in FIG. 7 the timing is such that the positive voltage pulse is applied to the plates of the stepper tubes at the same time that one of the relays 1 to 10 operates. When there is an input signal sufficient to fire any of the tubes, therefore, an output current pulse is produced each time one of the relays 1 to 10 operates.

It will be noted that in FIG. 7 the intelligence-conveying pulses are indicated as measured downward from an arbitrary normal value, this value corresponding to zero message value. The reason for this is that if no stepper tubes fire, corresponding to zero impressed message voltage, the maximum voltage is transferred from the plate impulser 48 to the outgoing lead 49′. When one or more tubes 41 to 45 are fired the corresponding current flow through series resistor 48′ results in application of lower output voltage to output conductor 49′, this voltage being lowered in steps depending upon the number of tubes fired at one time. In other words, the voltage on conductor 49′ is highest for step 0 and lowest for step 5. In the spaces between the message pulses the impulser 48 connects resistor 48′ to a grounded resistance so that the voltage drops to zero during these spaces. This is not indicated in FIG. 7, however, since the spaces have no significance in themselves but are only for allowing the stepper tubes to restore between pulses. When in the late description the addition or subtraction of pulses is mentioned, the meaning is that the addition is downward from the arbitrary zero message line in FIG. 7.

The heaters for the stepper tubes 41 to 45 are supplied with heating current from alternating current source 35′ which may be a 60-cycle power main, for example. Variations in voltage in this supply are compensated for in their effect upon the firing points of the stepper tubes by rectifier 36′ and bias resistors 37′ for the individual stepper tubes so proportioned that any effect on the firing voltage caused by variation in heating current is just offset by the accompanying change in auxiliary bias applied to the grids from rectifier 36' via high resistors 37'.

As noted above, two transmission channels are provided for transmitting the fundamental pitch variations. The main channel is that previously indicated from vocoder analyzer channel 9 through the operate contact of relay 9 and over conductor 11 to amplifier 26. If this channel along were used, the total range of current representing fundamental pitch variations would be divided for transmission into six steps, including zero. Since it is desired to transmit more accurate indications of the pitch, provision is made for dividing each of these steps into six equal parts so that the range of pitch variations is divided into 35 parts (step 5 being divided into five parts). For the purpose of indicating fractional steps some of the output voltage from the message stepper 40 is brought back over conductor 12 to the upper one of the three large combining resistors 13 in the grid circuit of amplifier stage 14. Another of these large resistors is connected directly to vocoder analyzer channel 9, and the third is used for applying negative bias from battery 19'. These two first-mentioned voltages are applied to the grid of amplifier 14 in opposite potential so that they subtract on the grid. The difference voltage resulting from this subtraction represents the fractional value which the output stepper current has in excess of zero or of one or more integral steps. This fractional value is multipled by a factor of 3 in the amplifier 14 and by a further factor of 2 in amplifier 15 or a total of six-fold. When relay 10 operates and closes its contact it connects the output conductor 16 of amplifier 15 to conductor 11 leading to the input of amplifier 26. Thus, considering the distributor times represented by the relays 1 to 10, the fundamental pitch indication is transmitted in channel 9 and the fractional value is transmitted, as zero to five full steps, over channel 10.

Relay 9A operates between relays 9 and 10 to close conductor 17 leading from amplifier section 14 to amplifier second 15. The closure of circuit 17 impresses the output voltage in amplifier 14 across condenser 18 and this condenser retains its charge over the operating period of relay 10. Relay 9A operates a fraction of a millisecond after the operation of relay 9 and while the voltage in the output of stepper 40 is still registering the fundamental pitch indication of channel 9. The actual pitch indications in the analyzer channel 9, as noted above, vary relatively slowly so that comparison of the output of the message stepper with the current in analyzer channel 9 at this brief instant after the operation of relay 9 gives a sufficiently accurate indication of the fractional step value. The use of two pitch channels for transmitting indications of whole steps and fractional steps is disclosed and broadly claimed in Badgley-Miller application Ser. No. 495,124, filed July 17, 1943, now U.S. Pat. No. 3,912,868, issued Oct. 14, 1975. The process of sending whole-step indications, over one channel, and fractional-step indications, over another channel, is not limited to dividing into fractional steps only once since the subdivision can equally well be carried further by use of a corresponding number of channels greater than two. The use of six steps is not limiting since any suitable number can be used.

The amplifiers 14 and 15 are arranged to compensate for variations in cathode emission and variations in battery voltages. Considering the amplifier 14, the first half is a coupling stage giving unity ratio from input to output while the second stage produces threefold amplification. The 180° phase shift between the grid of the first stage and the grid of the second stage results in compensation of contact potential or cathode emission variations in this tube. It is desired to add the input voltages in the high impedance circuit 13 but to have the impedance in the circuit of condenser 18 small so that this condenser may receive its charge in the available short time. The use of negative feedback in the second half of amplifier 14 through resistor 19 helps to produce the desired low resistance condition in the charging circuit of condenser 18. Condenser 18 works into the open grid circuit of the first stage of amplifier 15 which is favorable to holding its charge for the requisite time. The various resistances connected in a potential dividing circuit between positive battery 14' and negative battery 19' effect compensation for battery voltage variations. The second amplifier 15 is essentially similar to the first described amplifier 14.

The output pulses from the message stepper are enciphered by means of key pulses illustrated as derived from a phonograph record 90, (FIG. 2) although these key pulses can equally well be supplied by mechanical means of known type. The record 90 is driven from a standard frequency source 91 which maintains the record speed highly constant. Record 90 has recorded on it not only the key pulses to be used for enciphering the various channel pulses but also a 500-cycle per second synchronizing wave for timing the functions of the various apparatus in this terminal. This 500-cycle wave is taken off through synchronizing band-pass filter 92 and is supplied to various circuits including the message stepper plate impulser 48 already referred to and the ring circuit 22; a phase adjuster 93 being included in the connection to the ring circuit 22 in order to provide the proper timed relation between the ring circuit and the message stepper.

The key pulse is recorded in the form of a suitably modulated high frequency wave, the key pulses occurring at the same rate as the pulses of the output stepper, that is, every 2 milliseconds. The modulated key wave is selected by key band-pass filter 94 and rectified at 95 to derive direct current key pulses which are filtered in low-pass filter 96 and applied to the key stepper 97 which may be a duplicate of the message stepper 40. The plate impulser 98 derives its timing wave from the output of filter 92. The key stepper provides key pulses 1.5 milliseconds long separated by 0.5 millisecond spaces and coinciding in time with the pulses in the output of message stepper 40, (see FIG. 7).

The output of the key stepper 97 is added to the output of the message stepper 40 in the high resistance potentiometer circuits 49 and 51 in the input of the reentry circuit 50. Gas tube 53 fires each time that no reentry is to take place and the summation voltage steps from the key stepper and message stepper augmented by the reentry pulse are applied to the input of the output stepper 60 which may be a duplicate of message stepper 40. If reentry is to take place, gas-filled tube 53 fails to fire since the summation message-plus-key steps change the voltage applied to the grid too far in the negative direction to permit tube 53 to fire and the resulting absence of current flow from tube 53 through output resistor 54 means that the additive effect present in the no-reentry case does not occur. This serves in effect to subtract numerically from the summation step value of voltage applied to lead 52 from resistance 49 as compared with the no-reentry case. Since the space current in tube 53 always has the same value when the tube is fired, a constant voltage is subtracted from the summation message and key voltage as is required for the reentry function. Positive plate voltage for the reentry tube 53 is supplied in the form of pulses from impulser 55 under control of the synchronizing wave from filter 92 by way of phase adjuster circuit 56. The timing of these pulses is indicated in the diagram of FIG. 7.

In regard to the reentry function as more fully explained in the Lundstrom-Schimpf disclosure, a subtraction of six steps is made from the summation of message-plus-key voltage whenever this summation has a value of six steps or more. The summation currents equal respectively to six, seven, eight, nine and ten steps are, therefore, converted into pulses having respectively zero, one, two, three and four steps. No higher value of output current is transmitted than step 5.

The output pulses from the reentry 50 are applied to the input of output stepper 60 which has its plate voltage supplied in pulses from pulse supply 61 under control of the synchronizing wave from filter 92 by way of phase adjuster 62. It will be noted that on step O output from reentry 50, all five tubes of the output stepper 60 fire and conversely no tubes fire on step 5.

The output pulse in stepper 60 resulting from the keying of the pulse in channel 1 occurs at the same instant that relay 1' is operated from the ring circuit 22 so that this pulse charges the condenser 82 which is connected across the grid circuit of the amplifier tube 83. This output pulse from stepper 60 last for 1.5 milliseconds and the timing of the relay 1' is such that it closes its contact for 0.5 millisecond in the middle of the output stepper pulse. Relay 1' then releases and 2 milliseconds later relay 2' is energized to transmit the middle portion of the channel 2 pulse from the output of the stepper 60 to condenser 84. These condensers 82, 84, etc., of which there is one for each outgoing multiplex channel, retain their charges throughout a full cycle of operation of the relays 1' to 10' and until the corresponding relay, such as relay 1', again operates to change the charge on the corresponding condenser, such as 82, to the value corresponding to the output stepper pulse then present. This means that the pulses transmitted into the individual multiplex channels are 20 milliseconds in length as indicated in the diagram of FIG. 7. Each of the multiplex channels 71 to 80 includes an amplifier 83 followed by a frequency modulated osciallator 100 to 109. Each oscillator has a different normal frequency and the frequency separation between the normal oscillator frequencies is sufficient to allow for the full frequency modulation produced in each oscillator by the pulses in the respective channel. These frequencies may have any convenient value, such as 500, 700, 900, etc. cycles, in respective channels. Each frequency may be shifted 20 cycles per step or a total of 100 cycles by way of illustration. The resulting output frequencies from the various oscillators are transmitted through separating band filters 110, etc. in common to the radio transmitter 111 of any suitable type for transmitting the waves to a distant point. The ten channels are in this way transmitted on a multiplex carrier wave basis by means of modulating pulses of 20 milliseconds duration, the pulses in succeeding circuits beginning and ending with a displacement in time of 2 milliseconds from channel to channel.

Figure 3:
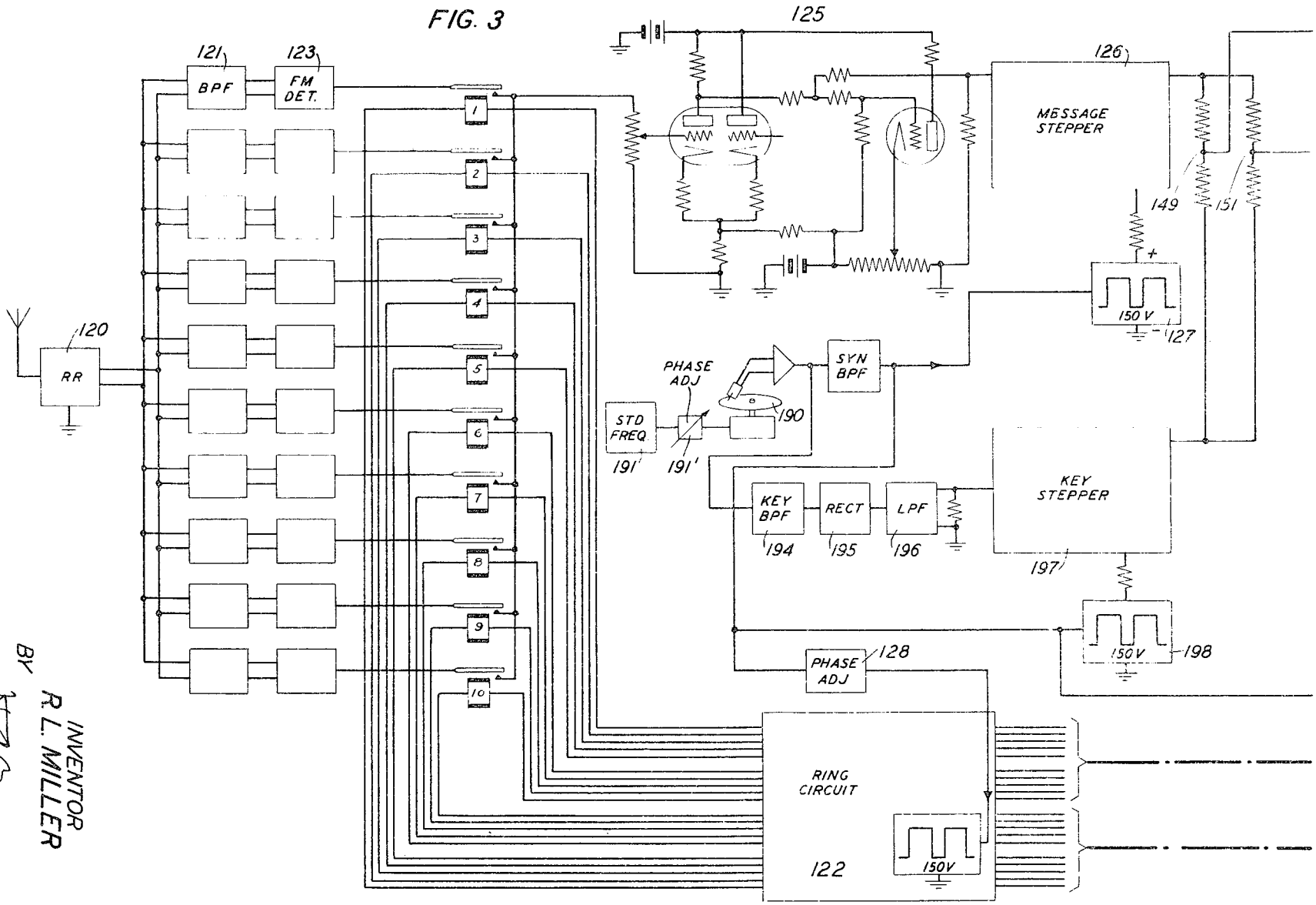
Figure 4:
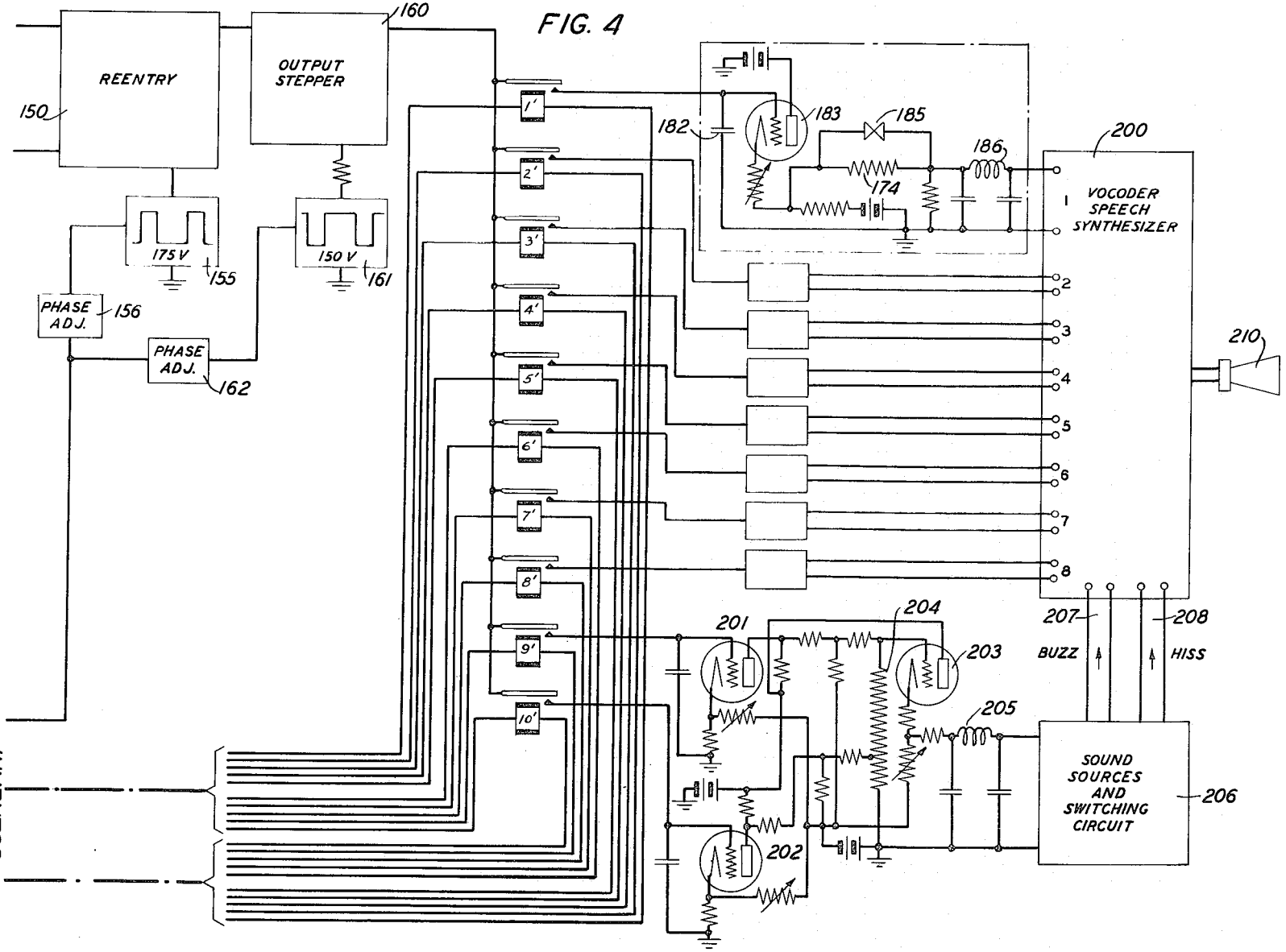

Referring to FIGS. 3 and 4, the multiplex carrier waves arriving from transmitter 111 at radio receiver 120 are separated by the ten band-pass filters 121 and applied to ten frequency modulation detectors 123 for recovering the direct current pulses by which the oscillators 100, etc. at the distant station were modulated.

A set of ten distributing relays 1 to 10 is provided controlled from ring circuit 122 which operates similarly to ring circuit 22 of FIG. 1 to cause the distributor relays to connect the frequency modulation detectors 123 in rotation to the common amplifier circuit 125. This amplifier may be entirely similar to the amplifier comprising 25 and 28 of FIG. 1. It operates to amplify the direct current pulses in the various receiver channels and to apply them to the message stepper 126 which may be a duplicate of message stepper 40. A duplicate key is provided at the receiving terminal illustrated as derived from a record 190 which is an exact duplicate of record 90 of FIG. 1. This record is driven from a constant frequency oscillator 191 and is initially started in exact phase relation with record 90 and is thereafter maintained in close synchronism with record 90 with the aid of variable phase adjusting network 191' which may be manually adjusted from time to time as found necessary. The 500-cycle synchronizing wave is derived through the filter 192 and applied to the impulser 127 of the message stepper 126, and also to other elements including the ring circuit 122 by way of phase adjuster 128. The key is derived through filter 194, rectified at 195 and the resulting direct current impulses are passed through low-pass filter 196 to the input of key stepper 197 which may be a duplicate of key stepper 97. Anode voltage pulses are supplied through pulsing circuit 198 under control of synchronizing waves from the record. The output of the key stepper is combined with the output of the message stepper in high resistance circuits 149 and 151. The reentry circuit 150 is a duplicate of reentry circuit 50 and serves in conjunction with the key stepper to derive the original message pulses. The reentry circuit is supplied with plate voltage pulses from inpulsing circuit 155 under control of the synchronizing wave by way of phase adjuster 156.

If we represent the output voltage on conductor 52 at the transmitter by S, the message voltage by M, the key voltage by K and the reentry voltage (voltage across 54 produced by discharge current from tube 53) by R, then $$S = C - (M + K - R)$$

where C is a constant.

This takes account of the fact that a higher voltage is impressed on the output stepper 60 for step O than for step 1, etc. as previously noted. By simple transposition, this gives:

$$M = C - (S + K - R)$$

showing that the message is recovered at the receiver by use of similar message-key combining circuits and similar reentry to those used at the transmitter.

The output of the reentry is impressed on the output stepper 160 which is similar to message stepper 40 and which is supplied with pulses under control of the synchronizing wave by way of phase adjuster 162 and impulse circuit 161.

Pulses existing in the output of the output stepper 160 are distributed by means of distributor relays 1' to 10' over the ten vocoder channels leading to the vocoder synthesizer 200. Considering channel 1, this receives a 0.5 millisecond pulse every time relay 1' operates, this pulse serving to charge the condenser 182 which retains its charge until relay 1' is again operated 20 milliseconds later, when condenser 182 receives a new charge corresponding to the output stepper pulse then existing. Impulses of 20 milliseconds duration are, therefore, applied to the grid circuit of amplifier 183 the output of which is passed through a low-pass filter 186 to the input terminals of channel 1 of the synthesizer circuit 200. Included in the output circuit from amplifier 183 is a silicon carbide or Thyrite resistor 185 shunted by high resistance 184 for producing expansion in the output currents to compensate for the compression introduced at the input of transmitting amplifier 25. Each of relays 1' to 8' operates in similar manner to impress successively received pulses on the input amplifiers of vocoder channels 1 to 8, each of these including a condenser corresponding to condenser 182 for converting the impulses into 20-millisecond pulses.

Relays 9' and 10', which as stated transmit the fundamental pitch indications, are connected respectively to direct current amplifiers 201 and 202 the outputs of which are combined and fed to the input of common amplifier 203. A potentiometer resistance 204 is provided in the grid circuit of tube 203 and is divided into two portions having the ratio of 5 to 1. The output of amplifier 201 is impressed across the entire resistance 204 while the output of the amplifier 202 is impressed across only the smaller portion, one sixth of the whole, of resistor 204. The impulses received by amplifier 203 over channel 10 are, therefore, reduced in value with respect to those received over channel 9 in the ratio of 6 to 1. In this way the fractional voltage steps received over channel 10 as full voltage steps are recovered in their true proportion as fractional steps and combined with the full step voltages received over channel 9. The output pulses from amplifier 203 are sent through low-pass filter 205 into switching circuit 206 which operates to determine whether tone waves representing vocal cord energy or continuous noise spectrum representing consonant energy is to be supplied over the corresponding circuits 207 or 208 into the synthesizer 200. This synthesizer may be of the type shown in the patent to Dudley, referred to, for reconstructing the original speech waves under control of the low frequency variations received over the spectrum channels 1 to 8, inclusive. The combined output waves from all eight channels are impressed on the common output speech reproducer 210.

Reference will now be made to FIG. 5 disclosing the details of the ring circuit. This comprises 10 gas-filled tubes 221 to 230 (of which five are shown and the others assumed to be included) connected in the manner indicated so that the discharge of each tube conditions the next succeeding tube for firing upon application of the next pulse to the common cathode circuit. The relays 1 to 10 and 1' to 10' are connected between the anodes and ground in pairs in the manner indicated. Considering the plate circuit of tube 221, for example, the plate is connected through a plate dropping resistor 235 and through the winding of relay 1 in series, thence through the winding of relay 1' and resistor 234 to ground. A condenser 231 is connected around the relay 1' and resistance 234 to produce the necessary amount of delay in the operation of relay 1' with respect to relay 1. As seen from the diagrams of FIG. 7, this delay is 1.25 milliseconds. From ground the external plate circuit of the tube 221 continues through the cathode impulser 241, common grid biasing circuit 240 and individual grid biasing circuit 238 to the cathode. Impulse producing circuit 241 is driven from standard frequency source 91 or, in the case of the system shown in FIG. 3, from standard frequency source 191.

When tube 221 fires, relay 1 operates for about 0.5 milliseconds and then releases. This is followed 1.25 milliseconds later by the operation of relay 1' for 0.5 millisecond. Also a charge is placed on condenser 242 which holds over through the next impulse time and by means of the potentiometer resistances 243 and 244 raises the potential of the grid of the next tube, 222, to the point where this tube will fire upon application of the next pulse from circuit 241 to the common cathodes. Also the firing of tube 221 stores a charge on the condenser of the grid bias circuit 238 to prevent tube 221 from refiring in the next impulse period. This same type of operation is repeated from each tube to the next and the 10 tubes fire in succession in a closed cycle. Relay 9A is connected in the plate circuit of tube 229 in a parallel branch comprising resistance 236, and relay winding of relay 9A which is shunted by a timing condenser 237. The time constant of this circuit is so adjusted that relay 9A operates about 1 millisecond (or slightly less) later than relay 9.

One advantageous feature of the ring circuit disclosed is the use of the individual grid biasing circuits 238 for each of the tubes for operating in the manner indicated above to prevent the same tube from firing repeatedly on succeeding pulses. The time constant of these individual biasing circuits may be made long enough so that the charge does not substantially disappear until just before the expiration of 10 firing periods, that is, until just before the same tube is to be fired again upon completion of one cycle. The common grid biasing circuit 240, which has a large RC constant, receives current from each tube as it fires and this action causes a steady biasing voltage to be maintained on the condenser of the biasing circuit 240 to condition all tubes for proper operation. This type of ring circuit is self-starting and will not develop short cycles within the entire cycle but all types will fire in one ten-tube cycle. If the circuit has been turned off until the charge disappears from the condenser in the biasing circuit 240, all tubes may fire the power is turned on or several tubes may fire but his quickly develops a large biasing voltage in the common bias circuit 240 and the tubes quickly settle down to a condition of firing one tube at a time in succession. The common biasing circuit 240 is also important in that it will compensate for possible variations in applied pulsing voltage.

Instead of connecting both relays of a pair, such as 1 and 1' or 2 and 2', etc., in the plate circuit of the same gas tube of the ring circuit and obtaining the delay in action between them entirely from a condenser-resistance circuit, such as 234 to 231, it is possible to obtain the necessary delay partly by connecting one relay of a pair in the output of one tube and the other relay of the pair in the output of the next tube. This is illustrated in FIG. 5A where relay 1 is connected in the output of tube 221 as before but relay 1' is connected in the output of tube 222. The same scheme would, of course, be followed throughout. A smaller delay is now required to be introduced by condenser 231', etc. This results in a better wave shape of the output current for operating the relays.

Figure 6:
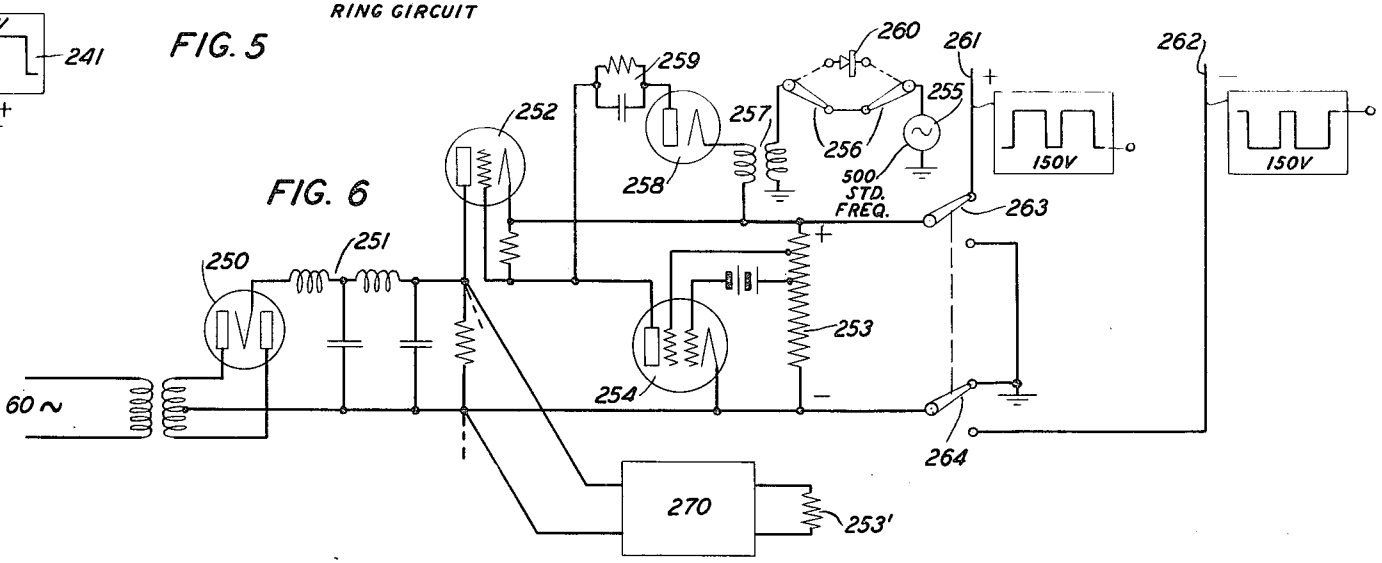
FIG. 6 is a detailed circuit schematic of the impulse producers shown at various points in the system.

The impulse producing circuits that are shown in connection with the steppers, reentry and ring circuit may be of the type shown in FIG. 6. This comprises a source of power, such as 60-cycle supply, and rectifier 250 operating through a smoothing filter 251 to supply in common direct current energy for all of the impulsing circuits at one terminal station. Considering the impulsing circuit shown in detail, some of this power is used to provide a direct current voltage across an output resistor 253, regulator tube 252 being connected in series in the circuit. Tube 254 derives its control grid voltage from a point in resistor 253 through a negative comparison battery to apply a voltage to the control grid which is constant so long as the voltage across resistor 253 remains constant. Regulation is obtained by varying the bias on the grid of regulator tube 252 from the plate of tube 254 to compensate for terminal voltage fluctuations.

Impulses occurring at 2-millisecond intervals are obtained by interrupting the current in the resistance 253 under control of a 500-cycle standard frequency source 255 which is applied through transformer 257 to a rectifier circuit 258 so poled as to apply highly negative pulses to the grid of regulator tube 252 every 2 milliseconds. The parallel condenser and resistance 259 is for developing a self-bias for the diode rectifier 258. This bias determines the duration of current flow through rectifier 258 in each alternate half cycle of the 500-cycle wave. This gives current pulses of half cycle or longer duration in resistor 253.

To produce shorter than half-cycle pulses in resistor 253, copper oxide rectifier 260 is switched into circuit by switches 256. This gives a peaked voltage wave form in the secondary circuit on the half cycles in which diode 258 is not conducting and flat wave form of greater duration in intermediate times, thus cutting off transmission through series tube 252 for more than half a cycle.

The voltage may be taken off from across resistor 253 in either polarity with respect to ground. For example, with the switches 263 and 264 in the full line position shown the negative end of resistance 253 is grounded and positive pulses are applied to the conductor 261 separated by spaces of zero voltage. The length of the positive pulses is determined by the amount of bias developed in the circuit 259. After the switches 263 and 264 are thrown to their alternate position the positive end of resistor 253 is grounded and negative pulses are supplied over conductor 262 corresponding in length to the positive pulses previously considered as supplied over conductor 261.

A second impulser 270 is shown deriving its power from filter 251 and still other impulsers may be similarly connected.

A type of relay construction that is well adapted for use as distributor relay 1 to 10, etc., is that disclosed in United States patent to W. B. Ellwood U.S. Pat. No. 2,289,830, July 14, 1942.

The invention is not to be construed as limited to the specific circuit details shown nor to the quantitative magnitudes that have been cited, since these are intended to be illustrative rather than limiting, and the scope of the invention is defined in the claims.

What is claimed is:

1. In a signaling system, a plurality of input circuits carrying signal currents, a coresponding plurality of individual output channels, a privacy equipment common to said circuits and channels for rendering said signal currents unintelligible, a first set of relays for operatively associating said input circuits one at a time with said privacy equipment, a second set of relays for operatively associating said privacy equipment with said channels one at a time, and a common timing circuit for operating the relays of each set in timed sequence.

2. In a signaling system, a plurality of signal circuits, a corresponding plurality of transmission channels, a common enciphering circuit including a signal and key combining circuit followed by an output stepper, a first distributor for connecting each of said signal circuits in succession to the input side of said common enciphering circuit and a second distributor for connecting each of said carrier channels in succession to the output side of said output stepper.

3. In a signaling system, a plurality of multiplex carrier wave channels, an individual grid-controlled vacuum tube feeding into each channel, a storage condenser across the grid-cathode terminals of each tube, a sending circuit comprising a stepper circuit including a plurality of gas-filled tubes having a common output resistor for receiving discharge current from one or more of said gas filled tubes depending upon the step value of the signal, means to apply periodic space voltage pulses to said gas-filled tubes for producing pulses of current flow through said output resistor, distributor means for applying the voltage existing across said output resistor across each of said storage condensers in succession in such time relation as to distribute a different one of said pulses to each condenser.

4. In a signaling system, a plurality of separate signal circuits, a corresponding plurality of multiplex carrier channels, common equipment and means for connecting the same between each of said circuits and a corresponding carrier channel comprising a first set of relays for individually connecting said circuits to said common equipment and a second set of relays for individually connecting said channels to said common equipment, and a discharge tube ring circuit comprising tubes operating in a closed cycle in timed relation, each tube having in its output circuit a relay of the first set and a relay of the second set and means to control the relative response times of the last-mentioned two relays.

5. In a signaling system, a signal circuit carrying signal current, a plurality of outgoing channels, distributor means to connect said signal circuit for transmission of a fraction of the signal current into the first channel, distributor means acting subsequently to determine the fractional part of the signal current remaining over and above the fraction so transmitted, and distributor means operating subsequently to transmit current indicative of such remaining fractional part of the signal current into another of said channels.

6. In a signaling system, a signal circuit carrying signal current, a plurality of outgoing channels, a stepper having an input and an output circuit, distributor means for intermittently connecting said circuit to the input of said stepper and for connecting the stepper output to the first of said channels, said stepper operating to impress on said channel signal currents divided into discrete steps, means to determine the difference between the signal current value and the signal current in the output circuit of said stepper, means to store a charge representing such difference, and means controlled by said distributor means for subsequently transmitting to another of said channels a current indicative of said stored charge.

7. In a signaling system, a circuit carrying signal current, a pair of outgoing channels, a stepper having an input circuit and an output circuit, said stepper producing output current varying in discrete steps under control of input signal current, distributor means for momentarily connecting said signal circuit to the stepper input and for connecting the stepper output successively to said two channels, means to determine the difference between the signal current in said circuit and the output current of said stepper, and means to produce an indication of such difference, said distributor means impressing on said stepper input a voltage proportional to said indication to set up a corresponding current in said stepper output at a time when said distributor means is connecting the stepper output to the second of said channels.

8. In a signaling system, a plurality of signal circuits, a plurality of multiplex carrier wave channels, common apparatus including a stepper circuit for converting instantaneous input current into discrete steps of output current, distributor means for connecting the input of said common apparatus to one after another of said signal circuits in rotation and for connecting the output side of said common apparatus to one after another of said channels in rotation, and means for enabling one of said channels to transmit indications of whole-step values of signal current in one of said circuits and another of said channels to transmit indications of fractional step values of signal current in said one of said circuits comprising means to derive a measure of said fractional-step value and means controlled by said distributor means, after disconnection of said common apparatus from said one circuit, to impress on said common apparatus a voltage proportional to said derived measure to produce in the output of said stepper a corresponding current at the time when said distributor means is connecting the output of said common apparatus to said other of said channels.

9. In a signaling system, a vocoder analyzer having a plurality of spectrum channels and a fundamental pitch-deriving channel, a transmission path, a common privacy equipment for said channels including a stepper circuit for producing output current in a finite number of amplitude steps in response to instantaneous values of input current, distributor means for impressing on said common privacy equipment the current in each one of said channels in successive time divisions, means to transmit the resulting output current from said equipment over said transmission path, means associated with said pitch-deriving channel for obtaining an indication of the difference between the pitch-defining current in said pitch-deriving channel and the value of the pitch-defining current corresponding to the output stepped current in said stepper, and means to transmit over said transmission path in a subsequent time division a current representing said difference indication.

10. In a signaling system, a vocoder analyzer having a plurality of speech spectrum channels and a fundamental pitch channel, a relay per channel for connecting each of said channels to a common circuit containing a stepper having an input and an output, said stepper producing output current in discrete steps in response to impressed input current, an additional relay, a timing circuit for operating all of said relays in succession in recurring cycles, said additional relay operating next in sequence to the relay that is individual to said pitch channel, means operative between the operating times of the pitch channel relay and additional relay for determining the excess of instantaneous fundamental pitch-defining current in said pitch channel over the step value present in the stepper output, a circuit closed by operation of said additional relay for impressing on the input of said stepper a current proportional to said excess, and a transmission path for transmitting currents from said common circuit to a distance.

11. In a time division multiplex system, means for providing a vernier channel for a main channel that includes a stepper, comprising means to store an indication of the difference between the step value of the signal transmitted in the main channel and the fractional-step value of the signal over and above said transmitted step value, and means to transmit in a subsequent time division a current indicative of said stored indication.

12. In a time division mulitplex system, means for providing a vernier channel for a main channel including a stepper, comprising means operative in one time division for applying main channel current to the stepper to produce in the stepper output a step value of current nearest to the true value for the signal in the main channel, means operating in the interval between said time division and the next for comparing the stepper output current against the signal in the main channel to determine the fractional-step value of the signal current over and above the corresponding step value, means to store an indication of said fractional-step value, and means operative in a subsequent time division to transmit over the vernier channel a current which gives a measure of such stored indication.

13. A system according to claim 12 including a relay to connect the main channel to the input of said stepper, a second relay to control storage of said indication and a third relay to connect said storage means to the vernier channel, and timing means to operate said relays in sequence in the order named.

14. A system according to claim 12 including circuit connections for inserting said stepper into said vernier channel in said subsequent time division.

15. In a secrecy system, a plurality of incoming message circuits, a common secrecy equipment including a message stepper, reentry circuit and output stepper each containing discharge devices having plate circuits and connected in tandem, in the order named, by means of resistance coupling circuits capable of transmitting direct current, means to connect said message circuits one after another in succession to said common equipment, and means to supply interrupted voltage to the plate circuits of said message stepper, reentry circuit and output stepper.

16. In a secrecy system, an output signal-quantizing stepper comprising discharge tubes feeding current to a common output coupling resistor in discrete amplitude steps, means to apply message voltages to the stepper input, a plurality of outgoing channels each including a vacuum tube having a condenser connected between a grid and cathode, and distributor means for momentarily closing metallic circuits between said output coupling resistor and the terminals of each of said condensers one at a time in succession.

17. In a space discharge tube ring circuit, a multiplicity of siimilar grid-controlled space discharge tubes, a common pulsing voltage supply for the space discharge electrodes of all of said tubes connected to drive the anodes of all of said tubes positive at the same time with respect to their cathodes, an individual grid biasing resistor and shunting condenser connected between each cathode and the negative pole of said supply, and condenser resistance timing circuits connected respectively from the anode of each tube to the grid of the next to impress actuating potentials upon the grids of successive tubes in succession, and means to insure discharge of but one tube on each pulse of said voltage supply comprising a proportioning of said biasing resistors and shunting condensers to provide a time constant of the value required to hold a negative bias on the corresponding grid sufficient to prevent discharge of the corresponding tube on the next supply pulse after the discharge of such tube.

18. The combination claimed in claim 17 including a resistor and shunting condenser connected in common between all of said individual biasing resistors and said negative pole for maintaining a substantially constant negative grid bias on all of said tubes additional to the individual bias voltages from said individual resistors and shunting condensers.

* * * * *